United States Patent [19]

Gauch et al.

[11] 4,417,534

[45] Nov. 29, 1983

[54] LUBRICANT SENSING DEVICE FOR SEWING MACHINES

[75] Inventors: Hermann Gauch, Moglingen; Wolf R. von Hagen, Hemmingen, both of Fed. Rep. of Germany

[73] Assignee: Union Special G.m.b.H., Stuttgart, Fed. Rep. of Germany

[21] Appl. No.: 277,432

[22] Filed: Jun. 25, 1981

[30] Foreign Application Priority Data

Jul. 26, 1980 [DE] Fed. Rep. of Germany ..... 3028456

[51] Int. Cl.[3] ..... D05B 71/00

[52] U.S. Cl. ..... 112/256; 184/1 C; 116/273

[58] Field of Search ..... 112/256, 43; 184/1 C, 184/6.4, 6.15; 116/273, 268, DIG. 7

[56] References Cited

U.S. PATENT DOCUMENTS

| | | | |
|---|---|---|---|
| 2,780,192 | 2/1957 | Attwood | 112/256 |
| 2,837,173 | 6/1958 | Ciecior | 112/256 X |
| 2,879,733 | 3/1959 | Pierce | 112/256 |
| 3,013,632 | 12/1961 | Matsubara | 112/256 X |
| 3,064,606 | 11/1962 | Terayama et al. | 112/256 |
| 3,536,866 | 10/1970 | Marforio | 112/256 X |
| 3,883,262 | 5/1975 | Schmedtkord et al. | 112/256 X |
| 4,072,126 | 2/1978 | Kemp | 116/268 |
| 4,122,789 | 10/1978 | Klundt | 112/256 |

FOREIGN PATENT DOCUMENTS

| | | | |
|---|---|---|---|
| 771586 | 4/1957 | United Kingdom . | |
| 828493 | 2/1960 | United Kingdom | 184/1 C |
| 963470 | 7/1964 | United Kingdom . | |
| 971914 | 10/1964 | United Kingdom . | |
| 1075024 | 7/1967 | United Kingdom . | |
| 1202168 | 8/1970 | United Kingdom . | |

OTHER PUBLICATIONS

*Technical Manual on Pegasus E-Series*, Pegasus Sewing Machine Mfg. Co. Ltd.

*Technical Manual on Class 36200 High Speed Cyl. Flatseamer Machine*, Catalog No. 118 L, Third Edition, 1960, p. 20–21.

*Technical Manual on Class 39,500 Streamlined High Speed Overseamers*, Catalog No. 103S, Second Edition, 1957, p. 16–17.

*Primary Examiner*—Werner H. Schroeder
*Assistant Examiner*—Andrew M. Falik
*Attorney, Agent, or Firm*—John W. Harbst; John A. Schaerli

[57] ABSTRACT

The present invention relates to a device for monitoring fluid flow through a pressurized lubrication system. The device includes a reciprocally arranged indicator that is responsive to fluid pressures within the lubrication system for exteriorally indicating the lubricant flow as a function of the reciprocal position of the indicator.

13 Claims, 2 Drawing Figures

LUBRICANT SENSING DEVICE FOR SEWING MACHINES

FIELD OF THE INVENTION

This invention relates to sewing machines and, more particularly, to industrial sewing machines subject to high speed operation over extended periods of time. It is concerned particularly with means for monitoring lubrication flow to parts requiring same.

BACKGROUND OF THE INVENTION

In contrast to splash type lubrication systems, many of today's machines employ pressurized lubrication systems for ensuring adequate machine part lubrication. In some splash lubrication systems, a viewing glass is used to assure adequate levels of lubricants. With pressurized systems, however, where lubricant is forced through interconnecting passageways, the flow of lubricant is not easy to perceive. Some pressurized systems provide an atomized stream of lubricant to be discharged into a viewing glass. As will be appreciated, an atomized stream of lubricant against the viewing glass, in a position removed from the immediate working area, is not readily conspicuous to the operator. Accordingly, if something should affect the flow of lubricant in such a system, an operator may not quickly envision that lubricant is not being distributed as required. Thus, with today's increasing machine speeds, there is an increasing need for an indicator which allows an easy and quick evaluation of lubricant flow through the pressurized system.

SUMMARY OF THE INVENTION

In view of the above, and in accordance with the present invention, there is provided a device which virtually eliminates the heretofore known problems. The present invention includes a device adapted for reciprocal movement relative the machine frame. The device is arranged in communication with, and is positionally responsive to fluid pressures within the pressurized lubrication system. With the present invention, an exteriorally conspicuous indicator is positioned as a function of the lubricant flow through said system.

It is therefore a primary object of this invention to provide a device for indicating fluid flow in a pressurized lubrication system.

Another object of this invention is the provision of a lubricant flow indicator which is effective, simplistic, and easily adaptable to existing systems.

Another advantage of the present invention is the provision of an indicator which is associated with the lubrication system in a direct and simple arrangement.

Other characteristics and advantages of the device will be apparent from the detailed description which follows of a preferred embodiment, which description refers to the accompanying drawings wherein.

DETAILED DESCRIPTION OF THE INVENTION

Figure 1:
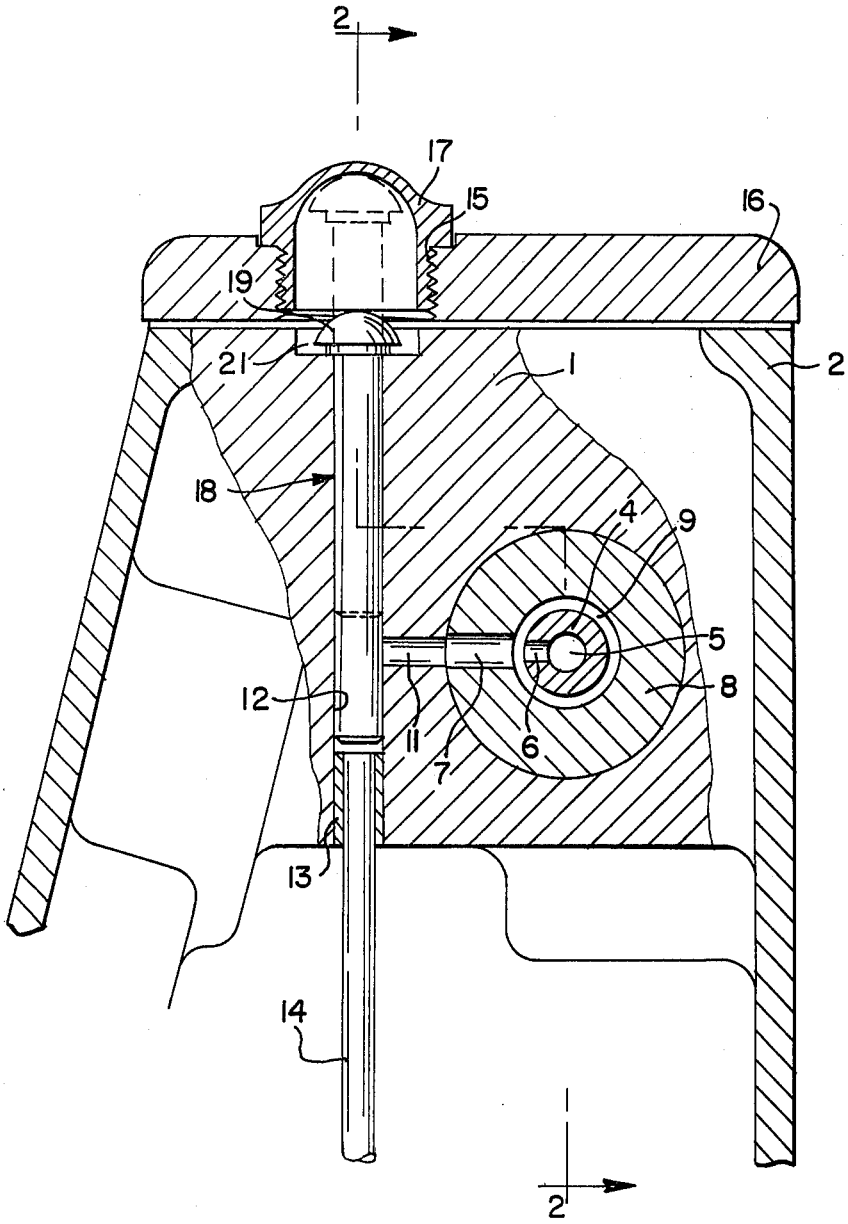
FIG. 1 represents a cross-sectional view through the standard or support part of the sewing machine frame illustrating the present invention applied thereto.

Referring now to the drawings, wherein like reference numerals indicate like parts throughout the views, there is shown an upper arm portion of a sewing machine frame or housing 2 having a transverse web or wall 1. Journaled for turning movement in the frame is a shaft 4 which may be supported for rotation in bushing or bearings 3 carried by the transverse web.

The sewing machine is provided with a pressurized lubrication system including plumbing arranged internally of the machine for delivering lubricant to the machine parts requiring same. The plumbing of the present invention includes a series of interconnected passageways for distributing lubricant throughout the machine. In the illustrated embodiment, the upper shaft of the machine 4 is provided with a longitudinal lubricant conducting bore 5 with a radial port 6 arranged in communication with the bore 5. A collar or sleeve 8 formed with an annular grove 9, slightly larger than the external diameter of shaft 4, is arranged in the wall 1. A port 7, formed in collar 8, leads from the annular groove 9 to the exterior of the collar. A lubricant conducting passageway 11 is effective to allow communication between the collar port 7 and a passageway or duct 12 extending transverse to the lubricant conducting bore 5. One end of the passageway 12 opens to the exterior of housing 2. The passageway 12 is connected, as at 13, with a lubricant conduit 14 leading from a lubricant pumping device (not shown). In this manner, a forced flow of lubricant may be delivered to passageway 12 from whence it flows through the interconnecting passageways 11, 7, and 6 to be lubricant conducting bore 5 and is distributed to parts requiring lubrication.

A transparent dome 17 is arranged at the open end of duct 12. The dome 17 extends exteriorally of the housing and is secured in an opening 15 in the top cover 16 of the machine.

A hydraulically actuated indicator 18, arranged in communication with and positionally sensitive to fluid pressures in the lubrication system, is arranged for sliding movement relative to the machine frame. In its present form, the indicator includes a stem portion and an integrally formed mushroom shaped cap portion 19. The stem portion should preferably be made of one piece steel construction. The term "one piece construction" should not, however, be literally construed. For purpose of this description, the concept of one piece or unitary construction should be interpreted to mean that the stem or body portion of the indicator is smooth and uniformly sized and is free of seals, springs balls, detents or other allied mechanisms not required for effective and efficient operation of the present invention. The stem portion of the indicator is arranged for free sliding movement in the passageway opening to the dome 17. As such, the indicator, in its preferred form, is limited to reciprocal linear movement. The body portion of the indicator has a slightly smaller but similar cross sectional shape to that of the passageway in which it is disposed. The cap portion of the indicator may be treated such that it is conspicuously visible and acts as a signal when projected toward the dome as will be discussed hereinafter. The downward movement of the indicator is limited by having the cap portion seat in a step 21 formed at the upper end of duct 12.

Figure 2:
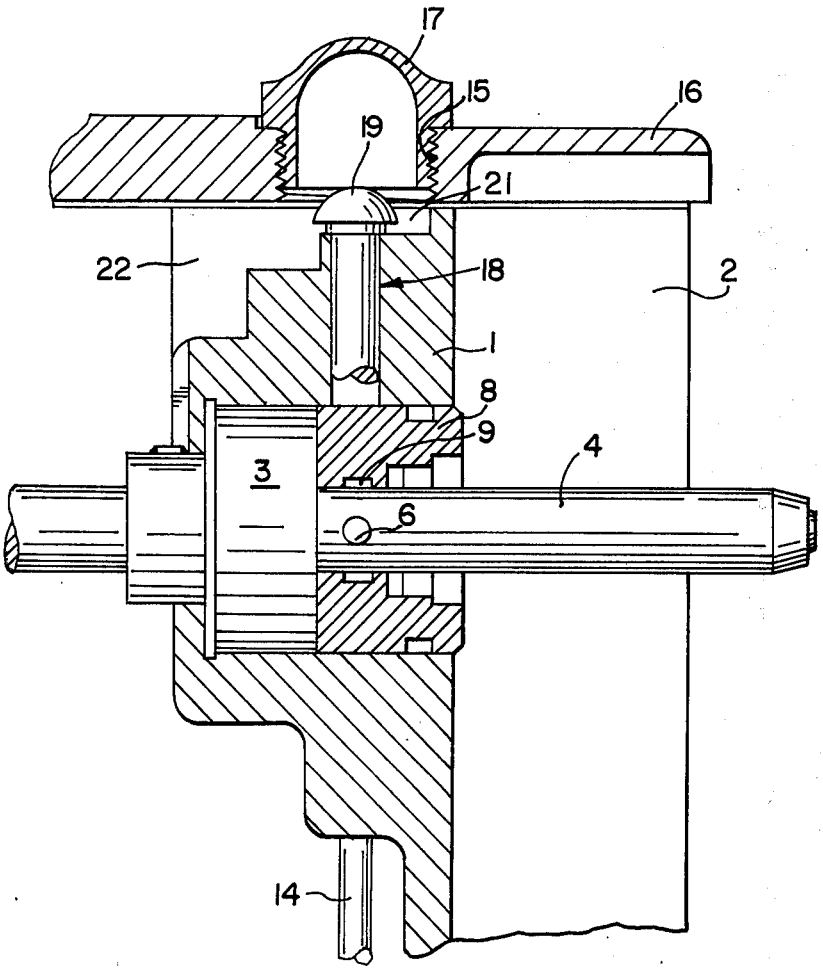
FIG. 2 is a sectional view taken along Lines 2—2 of FIG. 1.

As best seen in FIG. 2, the seat 21 opens, on one side, to a recess 22 which, in turn, opens to the interior cavity of the machine. When it is necessary to add lubricant to the machine, cap 17 may be removed and lubricant added through the bore 15. Passing through the bore 15, the added lubricant will pass from the seat 21 into the recess from whence it drains into the machine reservoir (not shown).

The indicator 18 is normally biased toward the position shown in solid lines in FIG. 1. In this position, the cap portion is not visible within the dome 17. In the preferred embodiment, when the indicator is in its initial or nonvisible position, the depending stem portion operatively extends between the lubricant supplying duct along the longitudinal receiving bore. That is, the depending stem covers the passageway 11 whereby preventing lubricant flow through that portion of the system serially arranged in communication with the lubricant supplying duct. It will be appreciated, however, that the present invention would serve the same function if arranged in a parallel relationship with the lubrication system.

When the machine is operated, the lubricant pump forces pressurized lubricant into conduit 14 which exits into the duct 12. The pressurized lubricant flow into the duct acts upon the indicator whereby displacing same. In the illustrated embodiment, the lubricant continually displaces the indicator until the depending stem portion uncovers or opens the interconnecting passageways 11, 7, 6, and 5 whereby allowing lubricant to flow through the system. For so long as the pressure in the system is sufficient to overcome the normal resistance of indicator 18, the system remains open. When the pressure in duct 12 displaces the indicator stem portion, the cap portion is projected into the transparent dome 17, as shown in phantom lines in FIG. 1, whereat it is exteriallly visible. Thus, lubricant flow is indicated as a function of the reciprocal position of the indicator. It will be further appreciated that any lubricant seepage from around the indicator is returned to the lubricant reservoir via the step 21 and recess 22.

Thus, it is apparent that there has been provided, in accordance with the invention, a lubricant sensing device for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus described the invention, what is claimed herein is:

1. In a sewing machine having a frame including an upper arm, a pressurized lubrication system arranged within said frame including a series of interconnecting lubricant passageways and a lubricant sensing device comprising:

indicator means arranged for free sliding movement within the upper arm of said machine, said indicator means having a rod like stem portion with a cap arranged at one end thereof, said stem portion being cooperatively arranged in said passageway such that it is positionally sensitive to fluid pressures therein and is adapted to position said cap so as to indicate the fluid flow and pressure in said system.

2. In combination with a sewing machine having a frame including an upper arm, a force flow lubrication system including means for distributing lubricant from a supply source to parts requiring same, means for signaling lubricant flow and pressure comprising:

a reciprocally arranged indicator having a free sliding substantially uniform stem portion cooperatively arranged within a branch of said lubricant distribution means in said upper arm, said stem portion being serially disposed between the lubricant supply source and parts requiring same and is responsive to pressure within the lubricant distributing means for exteriorally indicating the lubricant flow and pressure in said system as a function of the reciprocatory position of said indicator.

3. In combination with a sewing machine having a frame, an internal pressure lubrication system including a series of interconnecting passageways for distributing lubricant to various parts of the machine, a lubricant sensing device comprising:

a free sliding uniformly sized rod like member communicatively disposed in and lineraly guided by a supply branch of said passageways in an upper portion of the machine, said member being adapted to be moved from an initial position by lubricant pressure so as to open the lubricant passageways and having a cap portion visible exteriorly of the machine frame when said lubricant passage ways are open for indicating the lubricant flow and pressure.

4. A lubricant sensing device for a sewing machine having an internal pressurized lubrication system including plumbing for distributing lubricant to various parts disposed throughout a frame of the machine comprising:

lineraly actuated signal means visible exteriorly of the machine frame and including a one piece slider serially disposed in an upper portion of said machine frame in the lubricant path and operated pursuant to fluid pressure within the lubricant distributing means, said slider being displaceable from a starting position, in which it shuts off the passage of lubricant to the machine parts, to an operative position whereat the slider opens the plumbing leading to the machine parts requiring lubrication and said signal means indicates the quantity of lubricant flow through said system as a function of its linear position.

5. In a sewing machine having a frame, a pressurized lubrication system including a series of channels in said frame for delivering lubricant to various machine parts requiring same including a shaft means with a port means in communication with one of said channels, a lubricant sensing means comprising:

an actuatable indicator means arranged for free sliding movement in the upper portion of said frame such that it is serially disposed with respect to said shaft port means and responsive to the creation of a fluid pressure therewithin, said indicator means being adapted to display a symbol indicative of favorable lubricant flow and pressure in said system.

6. A lubricant sensing device for a sewing machine having a forced feed lubrication system including plumbing arranged internally of the machine for distributing lubricant to various parts of the machine, said lubricant sensing device comprising:

indicator means including a freely slidable member having a uniform and smooth body portion extending into a supply channel with said body portion having a similar cross sectional shape to the cross section of said supply channel to form a valve means between said supply channel and those parts of the machine requiring lubricant, said body portion having a cap at one end thereof for displacement between visible and non-visible positions, the position of said indicator means depending on the fluid pressure conditions within said system.

7. In combination with a sewing machine having a frame and a pressurized lubrication system including lubricant passageways arranged in said frame for distributing lubricant to various parts throughout the machine, a lubricant sensing device comprising:

indicator means slidably and freely mounted in an upper portion of said frame in series with the lubricant passageways such that in a first lowermost position it prevents lubricant passage to those parts requiring same and in a second position in which said indicator means is visible exteriorly of the machine frame when the lubricant passageways are open, said indicator means being normally biased toward its lowermost first position and being movable to said second position pursuant to the creation of lubricant flow and pressure in said system.

8. The invention according to claims 6 and 7 wherein said indicator means operates as a valve to control fluid flow through said system as a function of the position of said indicator means.

9. A sewing machine comprising:

a frame;

a transparent dome arranged exteriorally of said frame;

a pressurized lubrication system arranged inside of said frame for delivering lubricant throughout a series of interconnecting passageways, one of said passageways opening to said dome; and indicator means disposed in series with one of said passageways including an extended uniformly sized one piece stem portion having a slightly smaller but similar cross section shape to that of the passageway in which it is disposed with a cap arranged at the distal end thereof, said stem portion being freely arranged and acting as a control valve by being arranged in the passageway opening to said dome and being sensitive to fluid pressure within said system to open and close the lubricant flow in said passageways and to reciprocate said cap relative to said dome whereby indicating the lubricant flow and pressure in said system.

10. The invention according to claim 9 wherein said machine further includes a rotatable shaft supported in said frame in bearings which require lubrication, said shaft having an axial bore that communicates with said passageways for delivering lubricant therethrough with said stem portion of said indicator extending between said passageway and said axial bore in one of its reciprocatory positions.

11. The invention according to claim 9 wherein said cap portion is conspicuously colored whereby making it readily visible when projected toward said dome.

12. A sewing machine comprising, in combination:

a machine housing;

an upper rotary shaft provided with a longitudinal lubricant conducting bore with a radial port leading from said bore;

a collar arranged in said housing about said shaft and having lubricant conducting connections with said radial port;

lubricant conducting means for transmitting pressurized lubricant to said collar with a duct extending transverse to the lubricant conducting bore in said shaft, said duct opening to the upper region of the machine housing and a port leading from said duct to said lubricant conducting connection in said collar;

a transparent dome arranged at the open end of said duct; and movable means having a stem portion slidably disposed and guided within said transversely extending duct, one end of said movable means being projectable into said transparent dome in response to the creation of a fluid pressure in said lubricant controlling means.

13. A lubricant measurement apparatus capable of measuring the lubricant flow and pressure in a sewing machine forced feed lubrication system including a shaft conduit means and a displaceable indicator means arranged in an upper area of the sewing machine frame and having a freely slideable depending rod like body member communicatively disposed in serial communication with and guided within a lubricant supply conduit for said shaft conduit means, the position of said body member being controlled in accordance with the flow rate and pressure in said system so that in the event of inadequate lubricant flow or pressure said indicator means will not be visible exteriorally of the machine.

* * * * *